United States Patent [19]

Matsuo et al.

[11] Patent Number: 4,922,993

[45] Date of Patent: May 8, 1990

[54] METHOD OF FORMING A ZINC SLEEVE ON AN INSULATOR PIN

[75] Inventors: Hiroto Matsuo; Iwaji Kawamoto, both of Nagoya; Masamichi Ishihara, Ama; Takaaki Nakagawa, Komaki, all of Japan

[73] Assignee: NGK Insulators, Ltd., Japan

[21] Appl. No.: 301,126

[22] Filed: Jan. 25, 1989

[30] Foreign Application Priority Data

Feb. 9, 1988 [JP] Japan ..... 63-29419

[51] Int. Cl.[5] ..... B22D 19/04

[52] U.S. Cl. ..... 164/104; 164/100; 164/102

[58] Field of Search ..... 164/91, 98, 100, 101, 164/102, 103, 104, 105, 112, 122, 122.1, 126, 127, 128

[56] References Cited

U.S. PATENT DOCUMENTS

| | | | |
|---|---|---|---|
| 1,807,689 | 6/1931 | Deputy | 164/103 |
| 1,961,399 | 6/1934 | Snook | 164/122.1 |
| 3,912,544 | 10/1975 | Sabatino | 164/102 |
| 3,945,423 | 3/1976 | Hannig | 164/100 |
| 4,785,522 | 11/1988 | Biro | 164/103 |

*Primary Examiner*—Richard K. Seidel

*Attorney, Agent, or Firm*—Arnold, White & Durkee

[57] ABSTRACT

The disclosed method forms a zinc sleeve on an insulator pin by dipping the insulator pin in molten zinc at about 450°-650° C. to heat and wet the insulator pin with the molten zinc, setting the hot and wetted insulator pin in a die having an open-top cavity in such a manner that an annular open-top molding cavity is defined around the insulator, the die being at about 50°-300° C. when receiving the insulator pin, pouring molten zinc in the annular molding cavity through its open top, and solidifying the zinc thus poured.

2 Claims, 2 Drawing Sheets

METHOD OF FORMING A ZINC SLEEVE ON AN INSULATOR PIN

BACKGROUND OF THE INVENTION

1. Field of the Invention

This invention relates to a method of forming a zinc sleeve on an insulator pin.

2. Related Art Statement

Insulators such as suspension insulators are generally coupled in series so as to form insulator strings, and ground side ends of such insulator strings are suspended from arms of transmission line towers so as to hold line conductors at the opposite ends thereof. The insulator strings provide electrical insulation between the line conductor and the ground. However, when the insulator surfaces are contaminated and moistened, a leakage current flows along the surfaces of the insulating bodies of the insulators such as insulating porcelain bodies. The leakage current tends to cause electrolytic corrosion of metallic insulator pins (to be referred to as insulator pins, hereinafter) of the insulators. If such corrosion occurs inside the cement which bonds the insulator pin to the insulator body, it may crack the insulator body. On the other hand, if such corrosion occurs on the insulator pin outside the insulator body, the corrosion current tends to remove metal from the insulator pin to reduce its diameter, and in the worst case, the insulator pin may be broken at the corroded portion by the load of the line conductors.

To solve the electrolytic corrosion problem of the insulator pin, a zinc sleeve has been used. Referring to FIG. 4, a typical insulator pin 11 of a suspension insulator is firmly secured to an insulator body 8 by burying its enlarged end portion 11*a* in the inside of a cylindrical closed-top core 8*a* of the insulator body 8 by cement 9. An enlarged coupling portion 11*b* is formed at the opposite end of the insulator pin 11, which portion 11*b* fits in the socket hole of a metal cap 10 of another insulator so as to facilitate connection of the insulators. In addition to the enlarged end portions 11*a* and 11*b*, a large-diameter zinc sleeve 11*c* is formed at an intermediate portion of the insulator pin 11 as an integral part thereof, so as to minimize the burning or the metal-removing effects of the above-mentioned leakage current.

FIG. 3 shows a typical conventional method for making the zinc sleeve 1*c*. A die 2 with molding cavities 2*b* is separable into two parts, and it is placed on a support table 1. The die 2 has through holes 2*a*, each of which is concentric with the corresponding cavity 2*b*, and separately prepared insulator pins 11 are inserted in the holes 2*a*, respectively. The enlarged end portion 11*a* of each insulator pin 11 is supported by a holder 4. Molten zinc 5 is poured into the molding cavities 2*b* through a pouring basin 2*c* and the gate holes 2*d* of the die 2, so as to cast the zinc sleeves 11*c* in the molding cavities 2*b*.

The above conventional method to form the zinc sleeve 11*c*, however, has the following two major problems. The first problem is that the presence of the pouring basin 2*c* and the gate holes 2*d* results in formation of extra projections on the zinc sleeves 11*c*. To finish the insulator pins 11 after the molding of the zinc sleeves 11*c* thereon, additional work of cutting off such projections and polishing the cut surfaces is required. Further, the amount of molten zinc necessary for the formation of the zinc sleeves 11*c* is increased by an amount corresponding to the volumes of the pouring basin 2*c* and the gate holes 2*d*, so that losses of zinc material and heating energy increase accordingly. Due to the need of extra finishing work and the increased losses, the conventional method of forming the zinc sleeves 1*c* is costly.

The second problem is in that the probability of forming small cavities within the metal of the zinc sleeve 11*c* is high, because both the temperature $T_m$ of the die 2 and the temperature $T_p$ of the insulator pin 11 are low when the molten zinc is poured in the molding cavity 2*b* and the cooling and solidification of the molten zinc in the cavities 2*b* proceed both from the outer surface and inner surface of the annular sleeve 11*c* toward the inside thereof. Thus, the yield rate of a good product by the conventional method is rather low, e.g., about 30%.

SUMMARY OF THE INVENTION

Therefore, a first object of the invention is to solve the above first and second problems simultaneously, by providing an improved method of forming zinc sleeves on insulator pins.

A second object of the invention is to solve the above second problem of the conventional method by providing a simple improvement.

To fulfill the above object of the invention, with a method of forming a zinc sleeve on an insulator pin according to the invention, a separately prepared insulator pin is dipped in molten zinc at about 450–650° C. and heated substantially to the temperature of the molten zinc. The insulator pin is removed from the molten zinc, and the insulator pin, wetted with the molten zinc, is set in a die having an open-top cavity in such a manner that an annular open-top molding cavity is defined around the insulator pin within the open-top cavity. The die is heated at about 50–300° C. when the insulator pin is set therein. Molten zinc is poured in the annular cavity through the open top thereof, and the zinc in the annular cavity is solidified. Thereby, a zinc sleeve is formed on the insulator pin as an integral part thereof.

After being poured in the above-mentioned annular molding cavity of the die having an open-top cavity, the molten zinc in the molding cavity is solidified, starting from the lower end thereof, and the zinc solidification proceeds upwardly. Thus, the risk of forming small cavities within the metal of the molded zinc sleeve is minimized. Besides, the molten zinc is poured directly into the annular molding cavity through its open top, so that when the thus molded zinc sleeve is parted from the die it is free from any projections due to pouring basin and gate holes. Accordingly, the conventional process of cutting such projections and finishing the cut surfaces can be eliminated, and the amount of the molten zinc necessary for the molding is reduced, resulting in a considerable savings in production costs.

With another method of forming a zinc sleeve on an insulator pin according to the invention, after being wetted with the molten zinc as described above, the insulator pin is set in a two-part die in such a manner that an annular molding cavity is defined around the insulator pin. In this case, the two-part die should also be at about 50–300° C. when the insulator pin is set therein. Molten zinc is poured into the annular cavity, while the insulator pin is cooled so as to solidify the zinc in the annular cavity, whereby a zinc sleeve is formed on the insulator pin as an integral part thereof.

The wetting of the insulator pin with molten zinc ensures firm bondage between the zinc sleeve and the insulator pin. The cooling of the insulator pin after the pouring of the molten zinc in the molding cavity results in the pin temperature being lower than that of the die, and the solidification of the molten zinc proceeds from the outer surface of the insulator pin toward the cavity surface of the die. Thus, the risk of forming small cavities within the metal of the molded zinc sleeve is substantially eliminated.

BRIEF DESCRIPTION OF THE DRAWINGS

For a better understanding of the invention, reference is made to the accompanying drawings, in which.

Throughout different views of the drawings, 1 is a support table, 2 is a die, 2*a* is a through hole, 2*b* is a molding cavity, 2*c* is a pouring basin, 2*d* is a gate hole, 4 is a holder, 5 is molten zinc, 6 is a die, 6*a* is a through hole, 6*b* is a molding cavity, 6*c* is a slant passage, 8 is an insulator body, 8*a* is a core, 9 is cement, 11 is an insulator pin, 11*a* is an enlarged end portion, 11*b* is a coupling portion, and 11*c* is a zinc sleeve.

DESCRIPTION OF THE PREFERRED EMBODIMENT

A first embodiment of the method of forming a zinc sleeve on an insulator pin according to the invention, corresponding to claim 1, will now be described in detail by referring to FIG. 1.

Figure 3:
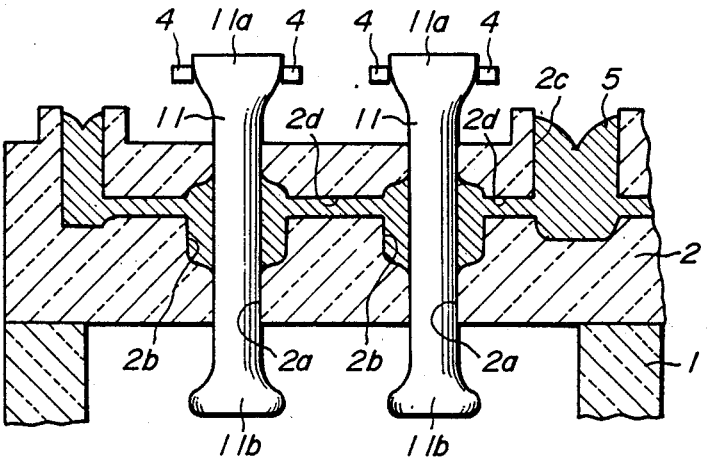
FIG 3 PRIOR ART
FIG. 3 is an explanatory sectional view for describing a conventional method of making a zinc sleeve.
Figure 4:
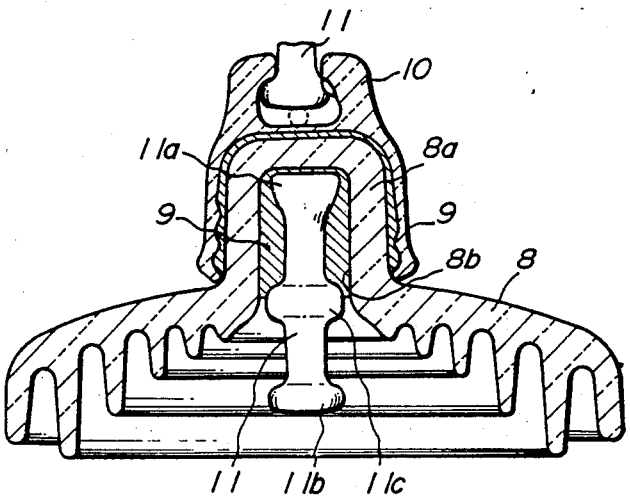
FIG. 4 is a vertical sectional view of a suspension insulator along a central axis thereof.

In this embodiment, a die 6 having an open-top molding cavity 6*b* is used, and the pouring basin 2*c* for receiving molten zinc 5 and the gate hole 2*d* of the conventional die 2 of FIG. 3 are eliminated. When an insulator pin 11 is set in a through hole 6*a* of the die 6, an open-top annular molding cavity is formed around the insulator pin 11. To facilitate pouring of the molten zinc 5 into the annular molding cavity, a slant passage 6*c* is provided on the top surface of the die 6.

To mold the zinc sleeve 11*c*, an insulator pin 11 is dipped in molten zinc at about 450–650° C. to heat it to about the same temperature as that of the molten zinc, for the purpose of preheating it and wetting its surface with the molten zinc. The above-mentioned die 6 is heated to about 50–300° C. Preferably, the die 6 is separable into two parts. The wetted insulator pin 11 is placed between two separated parts of the die 6, and such two parts are reassembled so as to set the pin 11 in the through hole 6*a* of the reassembled die 6. A holder 4 supports the enlarged end portion 11*a* of each insulator pin 11 in alignment with the molding cavity 6*b* of the die 6, so that an open-top annular molding cavity is defined around the pin 11. A predetermined amount of molten zinc 5 is poured to the slant passage 6*c* on the top surface of the die 6, so that the molten zinc 5 flows into the annular molding cavity. When the molten zinc 5 in the annular molding cavity is fully solidified, the die 6 is separated from the insulator pin 11 on which a zinc sleeve 11*c* is now formed. Thus, the process of forming the zinc sleeve 11*c* on the insulator pin 11 is complete.

Figure 1:
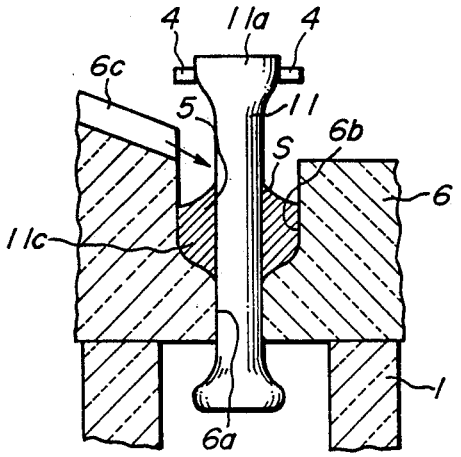
FIG. 1 is a fragmental sectional view of a die to be used in a method according to the invention, to which die an insulator pin is set in such a manner that an annular molding cavity is formed around the insulator pin.

With the structure of the die 6 of FIG. 1, cooling of the molten zinc 5, poured in the annular molding cavity, starts from the bottom of the cavity 6*b*, and the solidification of the molten zinc 5 gradually proceeds from the bottom toward the top surface thereof, until the top surface of the annular sleeve 11*c* is solidified. Such gradual solidification from the bottom to the top surface minimizes the risk of causing minute cavities within the metal of the zinc sleeve 11*c*, and the yield rate of the process of molding the zinc sleeve 11*c* is improved. Further, since the temperature of the insulator pin 11 is higher than that of die 6, the top surface S of the zinc sleeve 11*c* is curved as shown in FIG. 1. The die 6 of FIG. 1 does not have any pouring basin or gate holes, so that the thus formed zinc sleeve 11*c* is free from projections due to such pouring basin and gate holes. Thus, no machining is necessary for finishing the zinc sleeve 11*c*, for cutting off the projections and for grinding the cut surfaces. Accordingly, the process for molding the zinc sleeve 11*c* is simplified and the cost therefor is reduced.

A second embodiment of the method of forming a zinc sleeve on an insulator pin according to the invention will now be described by referring to FIG. 2. The die to be used in this embodiment is the same as the conventional die 2 which has been described hereinbefore by referring to FIG. 3, and only the process for molding the zinc sleeve 11*c* will be explained here while designating like parts by like numerals.

As a first step, an insulator pin 11 is dipped into molten zinc at about 450–650° C. to heat it to about the same temperature as that of the molten zinc, for the purpose of preheating it and wetting its surface with the molten zinc. The die 2 of the conventional structure is heated to about 50–300° C. The die 2, which is separable into two parts, is disassembled and the wetted insulator pin 11 is placed between two separated parts of the die 6, and such two parts are reassembled so as to set the insulator pin 11 in the through hole 2*a* of the reassembled die 2. A holder 4 supports the enlarged end portion 11*a* of each insulator pin 11 in alignment with the molding cavity 2*b* of the die 2, so that an annular molding cavity is defined around the insulator pin 11. While the insulator pin 11 is cooled by water or air stored in a vessel, molten zinc 5 is poured into the annular molding cavity through the pouring basin 2*c* and the gate hole 2*d* of the die 2. The vessel for storing the cooling water or air is shown by the dash-dot-dot lines of FIG. 2. After the molten zinc 5 in the annular molding cavity is fully solidified, the die 2 is separated from the insulator pin 11, and projections due to the gate holes 2*d* are cut off and the cut surfaces are ground. Thus, the process of forming the zinc sleeve 11*c* on the insulator pin 11 is completed.

Figure 2:
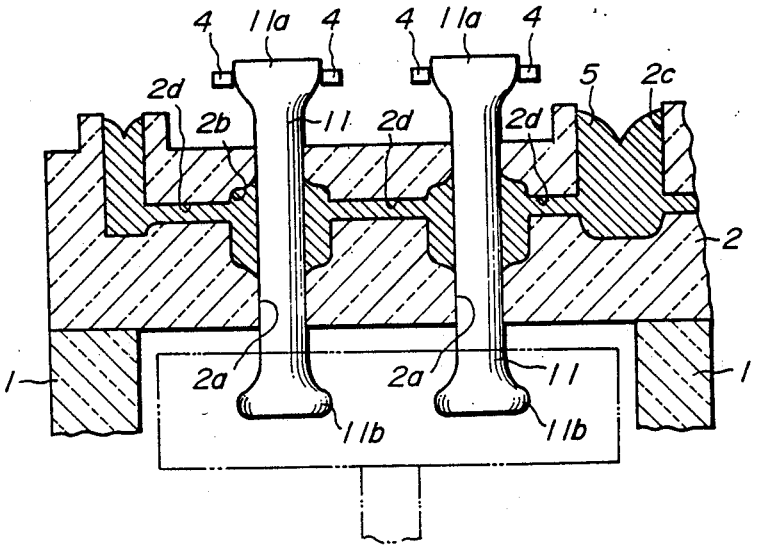
FIG. 2 is a sectional view of a two-part die to be used in another method according to the invention for forming a zinc sleeve.

In the embodiment of FIG. 2, since the insulator pin 11 is cooled simultaneously or immediately after the pouring of the molten zinc into the molding cavity 2*b*, the solidification of the molten zinc 5 in the annular molding cavity to form the zinc sleeve proceeds from the outer surface of the insulator pin 11 toward the inside surface of the molding cavity 2*a* of the die 2. Accordingly, the zinc sleeve 11*c*, being formed in the above-mentioned annular molding cavity, is prevented from formation of small cavities in the inside and inner surface thereof, and the surface of the insulator pin 11 is made free from such small cavities. Further, the insulator pin 11 is wetted with molten zinc before the molten zinc 5 is poured into the molding cavity, so that the strength of the bondage between the zinc sleeve 11*c* and the insulator pin 11 is improved.

The inventors have found through tests that the pin temperature $T_p$ and the die temperature $T_m$ are preferably selected by using the following formula.

$$T_p \leqq T_m + (150 \sim 600)^\circ \text{ C.}$$

As described in detail in the foregoing, with the method of forming a zinc sleeve on an insulator pin according to the invention, strong bondage of the zinc sleeve with the insulator pin is ensured by wetting the insulator pin with molten zinc before molding the zinc sleeve thereon, and the zinc sleeve is prevented from generation of small cavities therein by using an open-top annular molding cavity around the insulator pin. The use of the open-top molding cavity makes it possible to eliminate the pouring basin and the gate hole from the die, so that it is possible to dispense with the conventional finishing work of cutting off the projections due to such gate hole and pouring basin and grinding of the cut surfaces. Besides, the elimination of the gate hole and the pouring basin from the die results in a saving of the molten zinc by an amount corresponding to the volumes of such holes and basin. The elimination of the conventional finishing work and the saving of the molten zinc contribute to a considerable reduction of the cost of molding the zinc sleeve.

With the method of the invention, it is also possible to cool the insulator pin while molten zinc is being poured in the annular molding cavity. In this case, the solidification of the molten zinc in the annular molding cavity proceeds from the outer surface of the insulator pin to the inside surface of the molding cavity of the die, resulting in elimination of voids in the finished zinc sleeve.

Although the invention has been described with a certain degree of particularity, it is understood that the present disclosure has been made only by way of example and that numerous changes in details of parts and combinations may be resorted to without departing from the scope of the invention as hereinafter claimed.

What is claimed is:

1. A method of forming a zinc sleeve on an insulation pin, comprising the steps of:

dipping an insulator pin into molten zinc, thereby heating the insulator pin to substantially the same temperature as that of the molten zinc;

removing the insulator pin from the molten zinc;

placing the insulator pin wetted with the molten zinc into a die having an open-top cavity such that said open-top cavity defines an annular open-top molding cavity around the insulator pin, said die being at a temperature below that of said insulator pin when said insulator pin is placed therein;

pouring molten zinc into the annular molding cavity through the open top thereof; and solidifying the zinc in the annular molding cavity to form a zinc sleeve on a substantially centrally located axial portion of the insulator pin as an integral part thereof.

2. A method of forming a zinc sleeve on an insulator pin, comprising the steps of:

dipping an insulator pin into molten zinc, thereby heating the insulator pin to substantially the same temperature as that of the molten zinc;

removing the insulator pin from the molten zinc;

placing the insulator pin wetted with the molten zinc into a two-part die such that an annular molding cavity is defined around the insulator pin, said two-part die being heated to a temperature below that of said insulator pin when said insulator pin is placed therein; and pouring molten zinc into the annular molding cavity while cooling the insulator pin to solidify the zinc in the annular molding cavity and thereby form a zinc sleeve on a substantially centrally located axial portion of the insulator pin as an integral part thereof.

* * * * *